United States Patent [19]

Rusnak

[11] 4,306,722

[45] Dec. 22, 1981

[54] GOLF SWING TRAINING APPARATUS

[76] Inventor: Thomas L. Rusnak, 349 Toftrees Ave., Apt. 210, State College, Pa. 16801

[21] Appl. No.: 175,005

[22] Filed: Aug. 4, 1980

[51] Int. Cl.[3] ..... A63B 69/36

[52] U.S. Cl. ..... 273/186 R; 273/186 A; 273/183 E

[58] Field of Search ..... 273/186 R, 186 RA, 186 A, 273/186 B, 186 C, DIG. 26, DIG. 28, 181 H, 183 E

[56] References Cited

U.S. PATENT DOCUMENTS

| | | | |
|---|---|---|---|
| 3,194,563 | 7/1965 | Mackniesh | 273/186 R |
| 4,155,555 | 5/1979 | Fink | 273/186 R |
| 4,254,956 | 3/1981 | Rusnak | 273/186 R |

*Primary Examiner*—George J. Marlo

*Attorney, Agent, or Firm*—Carothers and Carothers

[57] ABSTRACT

A golf practice apparatus for indication of the face angle of the impact face on the head of a golf club at the time of ball impact when making a practice swing. The golf club is provided with a light-reflective surface, preferably the ball impact face itself, and a concentrated beam of light coming from a source spaced from the point of ball impact is positioned to direct the beam of light in a path adjacent the point of ball impact for reflection off of the reflective surface on the club head, as it is approaching the point of impact. A lens system is provided to focus the light as reflected off of the club to a given focal area on a light-diffusing surface such that the reflected light is focused at positions on the light-diffusing surface relative to the club face angle at the point of ball impact and a light sensor system is provided to sense light from these respective positions on the light-diffusing surface and correspondingly an indicator is coupled to the sensor system to indicate the golf club face angle at the point of ball impact. The apparatus is further adaptable to indicate club face angle for alignment during preliminary club head swings when addressing the golf ball prior to the actual golf club swing for ball impact.

17 Claims, 21 Drawing Figures

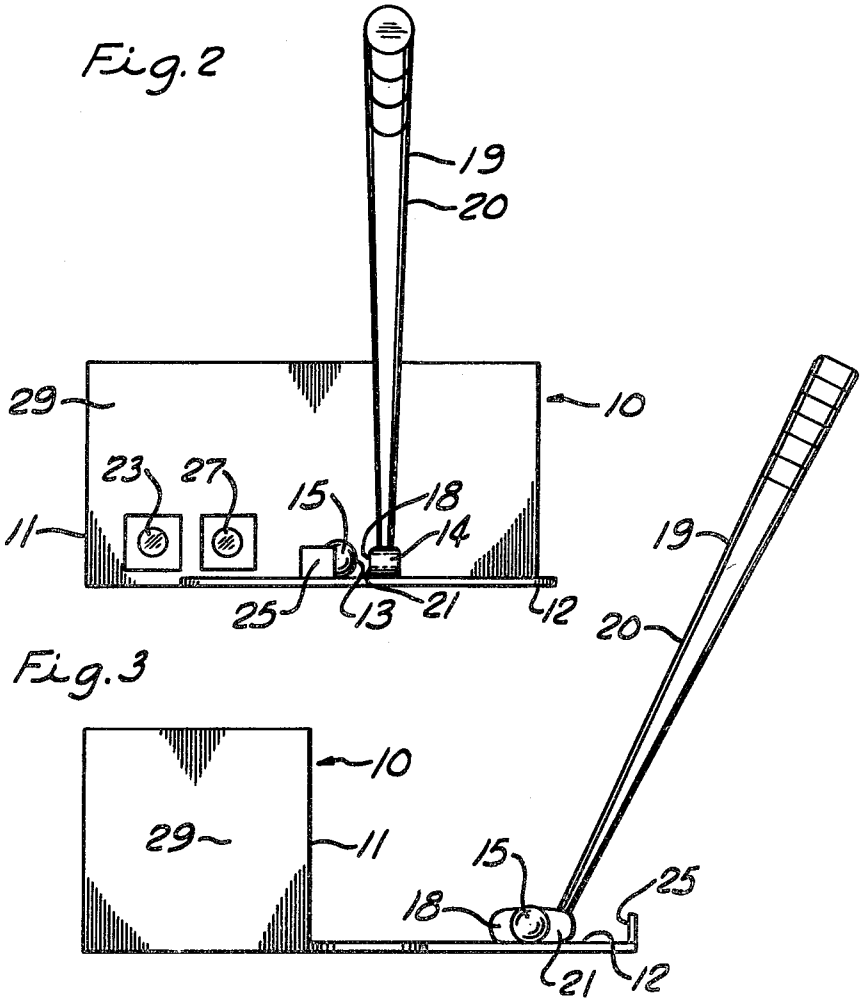
Fig. 2
Fig. 3
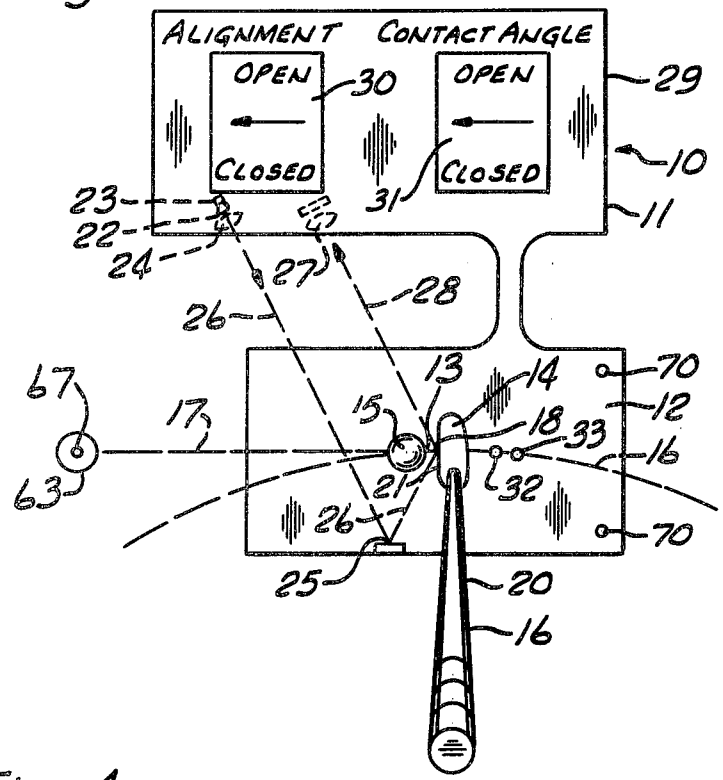
Fig. 1
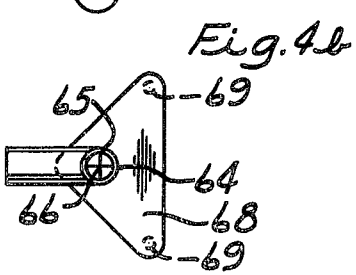
Fig. 4b
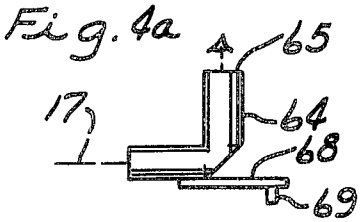
Fig. 4a

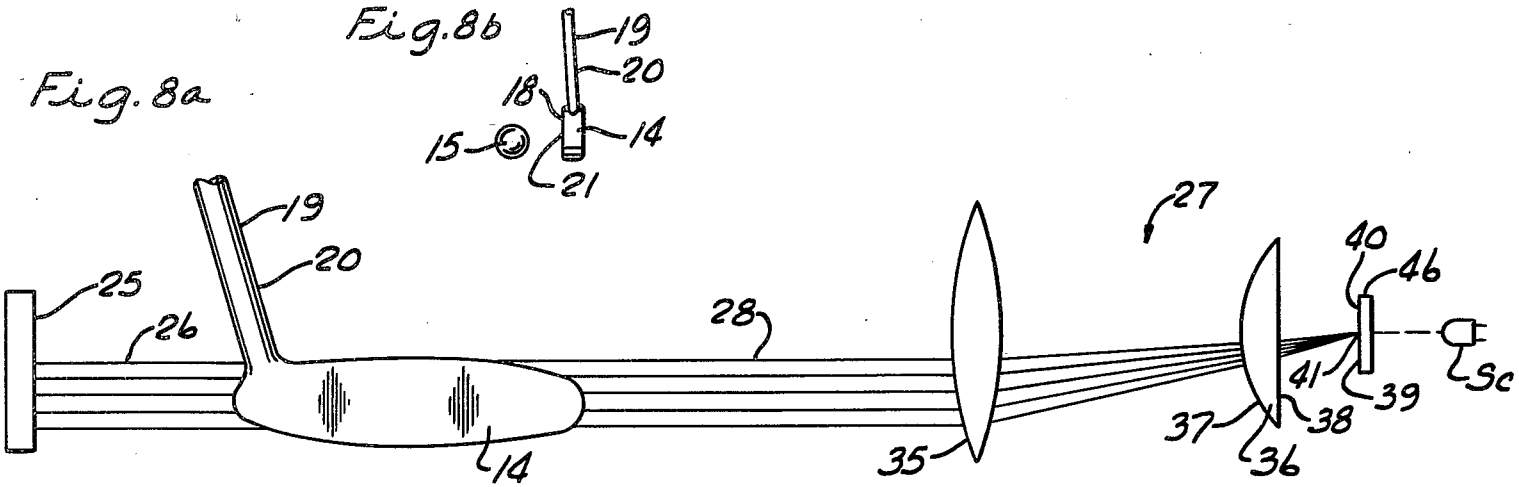
Fig. 8b
Fig. 8a
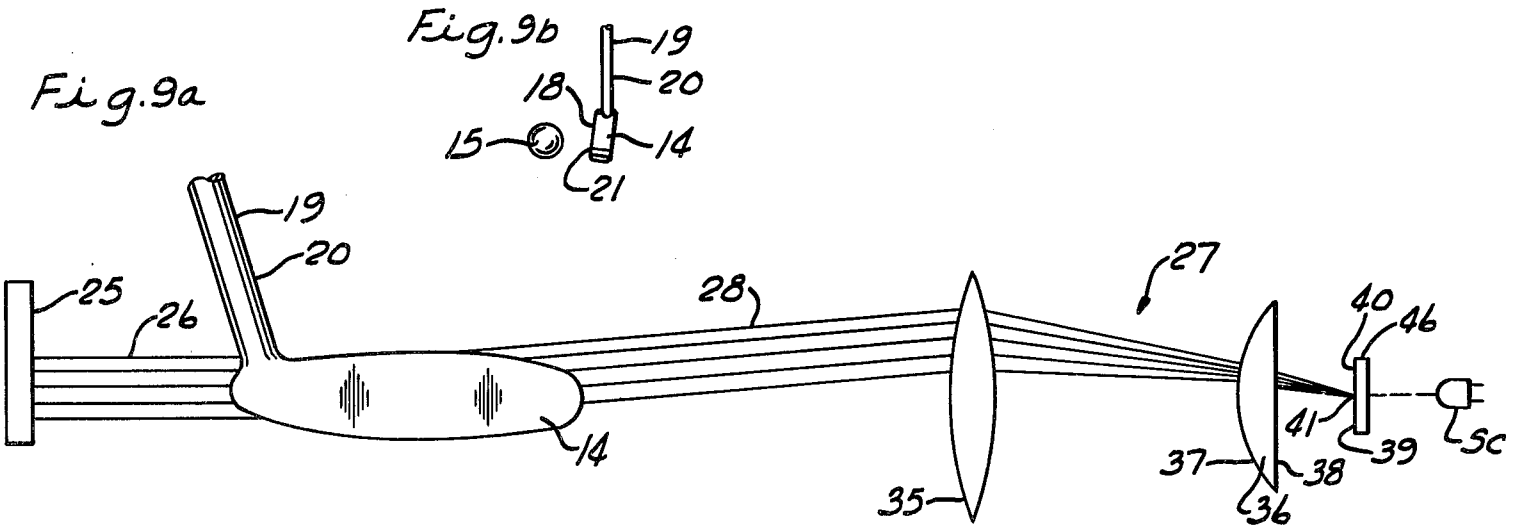
Fig. 9b
Fig. 9a

SD
SC
SE
SA
SB
46
45'
41
39
70
72
71
73
27
35
28
14
15
18
19
20
21
25
26

GOLF SWING TRAINING APPARATUS

BACKGROUND OF THE INVENTION

This invention relates generally to golf practice devices for detecting and automatically indicating quality of individual golf swings, and more particularly to such devices which optically and electronically measure and display the face angle of a golf club ball impact face at the point of ball impact during a practice swing.

In playing the game of golf, there are many factors that determine the flight of the golf ball when it is struck by the club. Ultimately, the entire cycle of the golfer's swing, his body position in relation to the ball, the grip of his hands on the club, etc., all have an effect upon the flight of the ball. However, one of the most important factors is the relationship of the face of the club head to the ball at the moment of impact. If the club face is "square" to the ball at the instant of impact, it is probable that the ball will travel in the intended line of flight or roll, even though other faults may be present in the swing of the club. This is particularly true with regard to putting.

To the end of providing a golf practice device which will indicate the relationship of the club face to the golf ball being struck at the moment of impact between the club and the ball, a number of devices of an electronic nature have been developed. One such device is illustrated in U.S. Pat. No. 3,194,563 issued to F. MacKniesh on July 13, 1965, and wherein a mirror is mounted to the golf club head perpendicular to the club face, and a beam of intense light is directed in a generally horizontal path adjacent the golf ball impact point. In this structure, as the golf club head is swung toward the point of impact with the golf ball, the beam of light is reflected back off the mirror to a series of photoelectric elements arranged in a uniformly-spaced relationship. An indicator which is coupled to the photoelectric elements is then responsive to indicate whether the club face is open or closed, or "square" to the ball at the time of impact.

This apparatus of the prior art certainly adds advances in the art, but does not permit readings as accurate as one would desire. Further, it is not capable of directly taking readings from the golf club face, and does not possess the capability of indicating whether the club face is slanted forward or back at the time of impact as well as being closed or open. In addition, it is further desirable to have such a golf practice apparatus wherein a conventional club, or the clubs of the particular golfer, may be utilized without special adaptation or attachment of special mirrors.

It is thus a principle object of the present invention to eliminate these disadvantages of the prior art and provide a golf practice apparatus which will automatically indicate face angle of the club head upon impact with extreme accuracy.

SUMMARY OF THE INVENTION

The golf practice apparatus of the present invention comprises a base having structure defining a normal point of impact, such as a golf ball or golf ball tee, etc., of a golf club head during a practice swing, and a golf club having a club handle and head and a vertical ball impact face on the head of the club. A light-reflective surface is affixed on the golf club at a predetermined position such that light reflected therefrom will be indicative of the angle of the club face when approaching the point of impact. In the preferable embodiment, this light-reflective surface is the club face itself, such as the polished metal face on a conventional putter, thereby permitting the use of one's own or conventional putters when utilizing the golf practice apparatus.

A source of intense light is mounted on the base at a position spaced from the point of impact, or where the ball is struck. This light source is positioned to direct a concentrated beam of light in a path adjacent the point of impact for reflection off the light-reflective surface when the face of the club head approaches the point of impact during a practice swing. A lens system is also positioned on the base to focus light from the light source as reflected from the light-reflective surface on the club to a predetermined focal area on a light-diffusing surface such that light is focused at positions on the light-diffusing surface, which positions are relative to the club face angle at the point of impact. The light-diffusing surface may, for example, be a granulated screen or a translucent plate such as a ground glass plate. A light sensor device is also provided in the base and positioned to sense light from the respective aforesaid positions on the light-diffusing surface for relative energization which is accordingly indicative of the face angle of the club face at the point of impact. Indicating means is coupled to the light-sensing device and is responsive to indicate the golf club face angle.

Generally, the light-sensing device will consist of a plurality of light sensors which are positioned in an array to sense light from the aforesaid respective positions on the light-diffusing surface for respective and relative energization of the sensors. The indicator is coupled to these respective sensors and responsive thereto or responsive to their respective relative energization to accordingly indicate the golf club face angle at the point of impact.

When the aforesaid light-diffusing surface consists of a translucent plate such as a plate of ground glass, the sensors may be positioned behind the plate as opposed to being positioned in front of the plate for sensing light from different positions off of the light-diffusing surface.

By utilizing the combination of the aforesaid lens system and the light-diffusing surface together with sensors for sensing light off of the light-diffusing surface, extremely accurate measurements and indications of golf club face angle at the point of impact are obtained which were not heretofore possible with golf practice apparatus of the prior art which utilize reflected light beams for indication of face angle.

In one embodiment, the aforementioned lens system is adapted to focus all light which it receives as reflected from the club or club face to a narrow predetermined horizontal focal area strip on the light-sensing device such that the light as reflected is focused at horizontal positions on the surface on the light-sensor device which positions are relative to the club face angle at the point of impact. As previously mentioned, this surface on the light-sensing device is preferably a light-diffusing surface and the sensing device also includes a plurality of light sensors positioned in a horizontal array to sense light from these respective horizontal positions on the light-diffusing surface for relative energization of the light sensors. By utilizing the light-diffusing surface, the light is somewhat diffused on the surface of the sensing device so that the array of light sensors can each obtain a relative reading which would not be as accurate if the focusing surface did not diffuse light, as in this latter case, the pinpoint focus of light on such a surface would make it much more difficult for the array of sensors to read, relative to each other, the amount of light being focused on the focal surface at any given focal position. Furthermore, in this latter case where the focal area on the light-sensing device is not light diffusing, a greater number of light sensors should be utilized in the array of light sensors to obtain accurate position sensing of the focused reflected light beam.

In the latter-mentioned embodiment wherein the lens means or system is adapted to focus all light which is received as reflected from the club face to a narrow predetermined horizontal focal area on the light-sensing device, the lens means preferably includes a lens having a cylindrical surface on one side facing away from this focal area or strip, with the axis of this cylindrical surface horizontally aligned with the strip, and the other side of the lens is substantially a flat vertical surface facing and in parallel alignment with this focal strip area. This lens arrangement makes certain that all light as reflected from the club face and received by the lens system will, with certainty, strike the narrow horizontal sensing area strip on the light-sensing device, even though the face angle of the club is inaccurately faced or tilted back or forward, thus permitting very accurate face angle readings of the club face with regard to whether the club face is open or closed. In a later-explained embodiment of the present invention, the golf practice apparatus is adapted to detect not only whether the face angle is open or closed, but also to indicate whether the club face is leaning back or forward at the point of ball impact.

The golf practice apparatus of the present invention in addition is preferably provided with a club head speed detection device in the base to detect a predetermined minimum velocity of the club head upon approaching the point of impact. This speed detection device or means will thereupon activate the indicating device to indicate club face angle only when this minimum velocity of the club head is attained. This particular embodiment thus prevents actuation of the device when the golfer makes "waggle" swings of the club head upon initial approach and alignment to the golf ball preparatory to making a practice swing.

In yet another embodiment of the golf practice apparatus of the present invention, it may further be adapted to indicate the alignment of the club face to the point of ball impact at the time the golfer is addressing the ball with initial alignment of the club face to the ball preparatory to making a practice swing. This is accomplished by providing a second indicating means which is coupled to the same light sensing device and is responsive thereto to correspondingly indicate the golf club face angle on approach to the point of ball impact during approach swings of the club head at velocities whch are less than the rforementioned predetermined minimum velocity which would activate the indicating device to indicate club face angle during an actual high velocity practice swing. In this manner, the golfer can determine whether he has proper alignment of the club face to the ball prior to even making the actual swing. With this latter alignment indication, the golfer can determine whether or not he has accurate alignment before the swing. The apparatus also indicates to him after the swing whether he maintains correct alignment upon impact with the golf ball.

Another aspect of the golf practice apparatus of the present invention is that it further defines a normal path of swing for a golf club head on correct approach to the point of impact, and a slight means or device is attachable to the base of the apparatus at a predetermined aligned position to permit a sight alignment of this normal path of correct swing with a golf ball target such as a cup which is spaced from the base of the device. Once alignment is made, then this sighting device may be removed. The advantage of this particular system is that an actual golf ball may be positioned at the point of impact, and since the sighting device was utilized, it will be known that when the golf ball is struck with a putter with the correct face angle, the golf ball will correctly travel to the prealigned target or cup and fall therein, thereby giving actual putting conditions.

As previously explained, golf practice apparatus of the present invention may be adapted to not only indicate whether the club face is open or closed, but also whether the club face is tilted forward or backward when approaching the ball on impact. In this embodiment, the lens system or means is adapted to focus all light which it receives as reflected from the club face to a predetermined focal area on the light-sensor device such that light is focused at vertical, as well as horizontal, positions thereon relative to the club face angle at the point of impact. Thus, in this embodiment, the focal area for the light on the light-sensing device will not consist merely of a horizontal strip, but also must have area in the vertical direction. Thus, the focal area would logically take on a rectangular or circular area as opposed to just a horizontal strip.

In this embodiment, then, the light-sensing device would include not only a plurality of light sensors positioned in a horizontal array, but in a addition, a plurality of light sensors positioned in a vertical array to sense light from the respective horizontal and vertical positions from the focal area for relative energization of the sensors. Here again, the focal area or surface is preferably a light-diffusing surface.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

FIG. 1 is a plan view of one embodiment of the golf club practice apparatus of the present invention.

FIG. 2 is a view in front elevation of the golf practice apparatus illustrated in FIG. 1.

FIG. 3 is a view in side elevation of the golf club apparatus illustrated in FIG. 1.

FIG. 4*a* is a view in side elevation of a sighting device which is attachable to the apparatus illustrated in FIG. 1 for preliminary alignment of the apparatus with a golf ball target.

FIG. 4*b* is a plan view of the sighting device shown in FIG. 4*a*.

FIG. 8a is a diagrammatic view in side elevation illustrating the operation of the optical system of the golf practice apparatus illustrated in FIG. 1.

FIG. 8b is a diagrammatic view in rear elevation illustrating club face angle with respect to a golf ball for the club head illustrated in FIG. 8a.

FIG. 9a is a diagrammatic view in side elevation illustrating the same principles as shown in FIG. 8a with the exception that the golf club face is angled back.

FIG. 9b is a diagrammatic view in rear elevation of the golf club head illustrated in FIG. 9a illustrating the face angled back in relation to a golf ball.

FIG. 11a is a diagrammatic view in side elevation illustrating the operation of the optical system of a second embodiment of the golf practice apparatus of the present invention for the indication of club face angle which is forward or back in addition to an open or closed face angle.

FIG. 11b is a diagrammatic view in rear elevation of the golf club head illustrated in FIG. 11a in relation to a golf ball.

FIG. 12a is a diagrammatic view in side elevation illustrating similar principles to those shown in FIG. 11a with the exception that the club face angle is illustrated back.

FIG. 12b is a diagrammatic view in rear elevation illustrating the face angle of the club head shown in FIG. 12a.

FIG. 13 is a diagrammatic view in rear elevation of the light focal-sensing area and array of sensors illustrated in FIGS. 11a and 12a.

FIG. 14 is a schematic diagram of the electronic circuitry utilized for operating the golf practice apparatus illustrated in FIGS. 11a and 12a.

DETAILED DESCRIPTION OF THE PREFERRED EMBODIMENTS

Figure 5A:
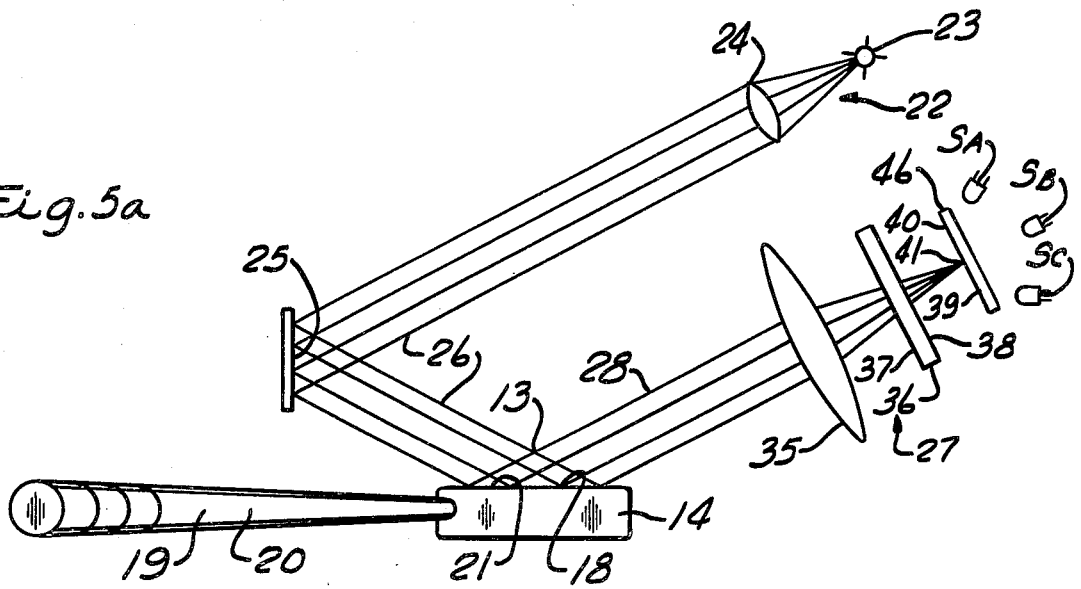
FIG. 5*a* is a diagrammatic plan view illustrating the operation of the optics of the golf practice apparatus illustrated in FIG. 1 when the golf club face is properly aligned to the golf ball.

Referring to FIGS. 1, 2 and 3, the golf practice apparatus 10 of the present invention is illustrated and generally comprises a base 11, which in turn includes floor or structure 12 defining a normal point of impact 13 of golf club head 14 with golf ball 15. Golf ball 15 may be an actual golf ball, or a golf ball image such as a heliographic image or a printed image on floor structure 12. Structure 12 further defines a normal path direction of swing as indicated by dashed line 16 in FIG. 1 for golf club 14 upon correct approach of golf club head 14 during a practice swing to the point of impact 13. If, in fact, golf ball 15 is a real golf ball as opposed to a heliographic image or printed image, golf ball 15 will travel in a straight path 17 if squarely struck by the ball impact face 18 of club head 14. Golf club 19 consists of club handle 20, club head 14 and ball impact face 18 on head 14.

A light-reflective surface 21 is affixed on club head 14 at a predetermined position such that light reflected therefrom will be indicative of the angle of the club face 18 when approaching point of impact 13. This light-reflective surface 12 as illustrated in FIGS. 1, 2, and 3, is, in fact, the polished metal face or surface of face 18 itself of golf club 19. Golf club 19 is here illustrated as a putter, and is in fact a conventional putter with a polished face 18 as may be readily found on the market. Thus, the advantage in the golf practice apparatus of the present invention is obtained wherein one may use his own putter or a conventional putter on the market as opposed to a specially made putter which may or may not fit the golfer.

The light-reflective surface 21 may, in fact, be a separate mirror surface which is attained at a predetermined angle to face 18, such as illustrated in the MacKniesh U.S. Pat. No. 3,194,563, but use of a polished face 18 of the club itself is preferred for the reasons set forth hereinbefore.

A source of intense light 22, consisting of bulb 23 and lens 24 is mounted on base 10 and spaced from point of impact 13 and is further positioned, with the aid of mirror 25, to direct a concentrated beam 26 in a path adjacent the point of impact 13 for reflection off of light-reflective surface 21 when face 18 is approaching point of impact 13 during a practice swing.

A lens means or system 27 on base 10 is positioned to focus light beam 28 from source 22 as reflected from club face 18 to a light sensing means or system within the housing 29 of base 10, as will be explained in greater detail hereinafter. An indicating means or device is also contained within housing 29 and is coupled to the light-sensing means and is responsive thereto correspondingly indicate the golf club face angle of face 18 at the point of impact 13 by means of meters 30 and 31. Alignment meter 30 indicates whether the face angle 18 of club head 14 is open or closed on approach of club head 14 to point of impact 13 during approach swings of the club head preliminary to an actual practice swing for actual impact with ball 15. Contact angle meter 31 indicates whether club face 18 is open or closed upon impact with ball 15 at point of impact 13 during an actual high velocity practice swing. Thus, the golfer may check his alignment prior to the swing and then is given an indication of the actual club face alignment after completion of a practice swing where actual impact is made with ball 15 or point of impact 13. Contact angle meter 31 is not actuated until club head 14 passes over the two velocity sensors 32 and 33 at a predetermined minimum velocity which would indicate that the swing is sufficiently fast that actual impact with the ball is intended. Velocity sensors 32 and 33 are merely respectively conventional light sensors such as those described in my co-pending patent application Ser. No. 962,757 filed Nov. 21, 1978 now U.S. Pat. No. 4,254,956. As club head 14 passes over sensors 32 and 33, light is blocked out by the shadow of the club head 14 and the velocity of club head 14 is accordingly determined by the time lapsing between successive overshadowings of sensors 33 and 32 in sequence.

Velocity sensors 32 and 33 are switch-on sensors which sense a minimum forward velocity of the golf club head to activate the detection circuit for contact angle meter 31. A time discriminating circuit discerns the elapsed time from when the leading edge of the club face 18 breaks the light or overshadows sensor 33 to the time that it overshadows sensor 32, thereby giving an indication of velocity, and meter 31 is thus not energized until this velocity is of sufficient value to indicate that a full swing of the golf club is being made, and not must a "waggle" ball address swing or an alignment swing on approach.

Figure 5B:
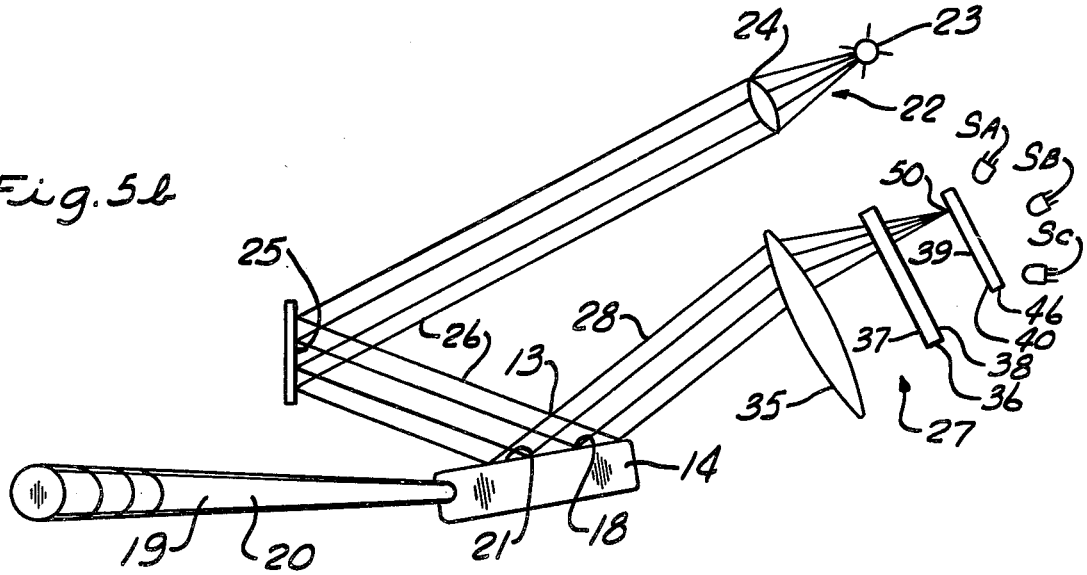
FIG. 5*b* is a diagrammatic plan view of the same illustration of FIG. 5*a* with the exception that the golf club face is in a closed position.
Figure 5C:
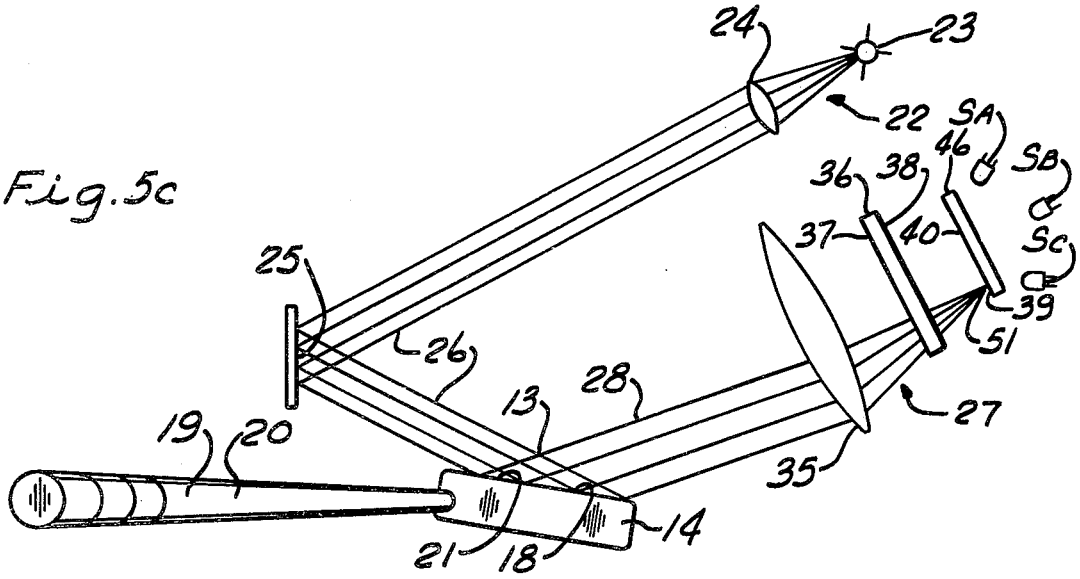
FIG. 5c is a diagrammatic plan view illustrating the same principles shown in FIG. 5a with the exception that the club face angle is shown in an open position.

FIGS. 5*a*, 5*b* and 5*c* better illustrate the optical operation of the golf practice apparatus. Like elements are designated with the same reference numerals as the apparatus illustrated in FIGS. 1, 2 and 3.

Referring to FIG. 5*a*, beam of light 26 is generated from source 22 by means of electric lamp or bulb 23 and lens 24. Beam 26 is reflected by means of mirror 25 so that it passes adjacent point of impact 13 for reflection off face 18 of club head 14. In FIG. 5*a*, club head 14 is illustrated "square" with the point of impact 13. In other words, club face 18 is neither open nor closed, in golfing terms, upon approach to impact with point 13. In other words, club head 14 is shown as pre-aligned correctly for correct contact with the golf ball, either in making preparatory alignments or just prior to impact during an actual practice swing.

At this point in time, light beam 26 is reflected off of surface 21, and this light beam 28 as reflected therefrom enters the lens means or system 27 which consists of duo-convex lens 35 and cylindrical-plano lens 36 having cylindrical surface 37 and plano surface 38.

Lens means or system 27 is positioned to focus light from source 22 as reflected in the form of beam 28 from light-reflective surface 21 to a predetermined focal area 39 of a light-diffusion surface 40 such that light 28 is focused at positions thereon such as position 41 relative to the club face angle of face 18 at the point of impact.

A plurality of light sensors, here three light sensors, SA, SB and SC, are positioned in an array, here in a horizontal array, to sense light from respective horizontal positions on light-diffusing surface 40 for relative corresponding energization of either or all of sensors SA, SB or SC. The indicating means or device, to be explained hereinafter in detail, is coupled to these sensors and is responsive to their respective relative energization to correspondingly indicate the golf club face angle at the point of impact.

Figure 7:
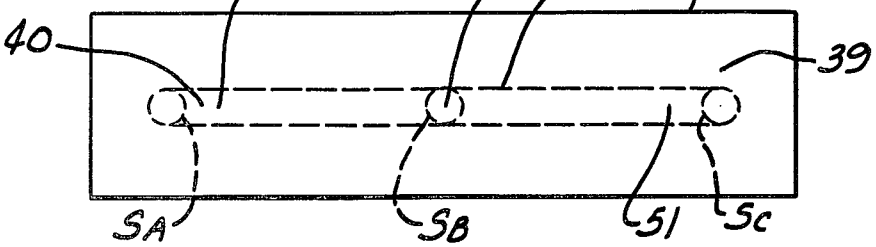
FIG. 7 is a view in front elevation of the focal surface shown in FIG. 6.

The lens system 27 in this particular embodiment is adapted to focus all light 28 which it receives as reflected from club face 18 to focal area 39 which in this particular embodiment is a narrow predetermined horizontal focal area strip 45 as best indicated in FIG. 7 by the dashed outline on the light-diffusing surface 40, such that all of the light 28 is insured to focus at horizontal positions, such as position 41 thereon, which positions are relative to the club face angle at the point of impact.

Figure 6:
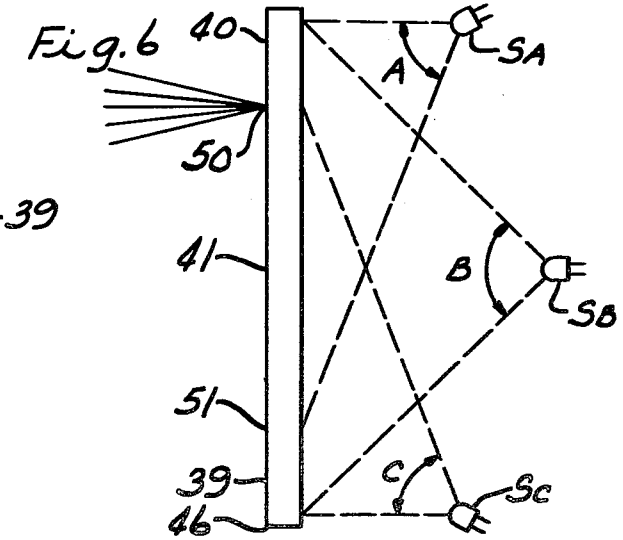
FIG. 6 is an enlarged top view diagrammatically illustrating the optical focal surface for the lightsensing device utilized in the golf practice apparatus of FIG. 1.

In this embodiment, light-diffusing surface 40 is the forward surface of a ground glass plate 46, illustrated in FIGS. 5*a*, 6 and 7. Thus, due to the lens system 27, all reflected light is brought down to respective focal points which fall within area 45 and these focal points can vary laterally to different horizontal positions depending upon whether the face angle of club face 18 is open or closed, but the focal points cannot vary vertically. This is accomplished particularly due to the effects of the cylindrical-plano lens 36, a side configuration of which can be more readily visualized in FIG. 8*a*. Due to the cylindrical surface 37 of lens 36, all light which this lens 36 receives is converged down to the horizontal strip focal area 45, although lens 36 will not prevent the focal points landing on strip 45 from having different horizontal positions thereon relative to the angle at which face 18 is aligned relative to the point of impact 13. This will be illustrated in greater detail with regard to FIGS. 5*b* and 5*c*.

As previously explained, and with particular reference to FIGS. 5*a*, 6 and 7, the light sensors SA, SB and SC are positioned in a horizontal array to sense light from different or respective horizontal positions such as positions 41, 50 and 51, for example (although the number of such horizontal positions are infinite), in order that these light sensors may sense light from these respective horizontal positions of the light-diffusing surface 40 within focal area 45 for relative energization thereof. With particular reference to FIG. 6, these light sensors SA, SB and SC would typically be phototransistors and since the focal surface 39 of the light-sensing device is ground glass plate 46, plate 46 is accordingly translucent and the sensors are therefore positioned behind the surface 39 for sensing as opposed to being positioned in front thereof, as might be the situation if plate 46 were not translucent.

Note that the respective light sensors SA, SB and SC are positioned such that they each have their own angle of even sensitivity or sensitive areas of detection A, B and C respectively, to read different, yet overlapping portions or areas of the focal strip 45. Thus, by way of example, if, as in FIG. 5*a*, the face angle of face 18 is "square" with the ball at the point of impact 13, which is the correct alignment such that the face is neither open nor closed, then all of the light 28 as reflected from surface 21 will be focused to focal point 41 in the center of focal area strip 45. Assuming this occurs, then most of the light will be sensed by center sensor SB, while the outside sensors SA and SC will read equal amounts of light, but with much less intensities than that of sensor SB. Since sensors SA and SC read equal amounts of light being received, comparison of their energizations will indicate that the club face is neither open nor closed.

However, should the club face 18 be in a closed position when making impact at the point of impact 13 as illustrated in FIG. 5*b*, the light focused by lens system 27 will fall at position 50 on focal area 45 of the light-diffusing surface 40 and accordingly, more light will be sensed by sensor SA than that sensed by sensor SC, and according to this relationship of energization, the apparatus of the present invention will indicate that the club face is closed, and the needles in meters 30 and 31 will indicate the exact degree of the angle of closure depending upon the difference of the amount of light sensed between sensors SA and SC.

As yet a further example, if the club face is in an open position at the time of impact such as illustrated in FIG. 5*c*, then the light coming through lens system 27 will fall on position 51 of focal area strip 45, and accordingly sensor SC will sense much more light than sensor SA, and the resultant difference in energization of these two sensors will cause the meters to indicate that the club face is open at the point of impact, and it will indicate the exact degree of openness.

Even if the housing structure 29 should slightly warp with use and make minor variations accordingly in the focusing ability of lens system 27, this will not change the accuracy of the light sensing of the apparatus of the present invention because of the light-diffusing characteristics of surface 40 because even if the focal positions would slightly change on the surface strip 45, the light is diffused so that the phototransistors in the form of sensors SA, SB and SC, still make accurate readings of the exact amount of light which is being received at any given position on the focal strip 45.

FIGS. 8*a* and 8*b* and FIGS. 9*a* and 9*b* better illustrate exactly how cylindrical-plano lens 36 functions to focus all light received within focal area 45 of the light-diffusing surface 40, no matter whether the vertical plane of face 18 of club head 14 is properly positioned vertically at the point of impact such as indicated in FIG. 8*b*, or whether the vertical face angle of face 18 is positioned back as shown in FIG. 9*b*, or even in a forward position.

With particular reference to FIG. 8*a*, the vertical extension of the plane of face 18 is correctly positioned straight up and down or absolutely vertical as illustrated in FIG. 8*b*. Light beam 26 is reflected off surface 21 of club head 14 to form a beam 28 and directed to a focal point by lens 35 while intermediate cylindrical-plano lens 36 insures that the focal point 41 will fall within focal area 45 due to the cylindrical curvature of lens 36.

However, supposing the golfer incorrectly has the club face 18 angled back as illustrated in FIG. 9*b* at the time of initial alignment or at the time of impact, then the light beam 26 as reflected off reflective surface 21 of face 18, will be directed slightly upward in the form of reflected beam 28 as illustrated in FIG. 9*a*. This beam is directed to a focal point again by duo-convex lens 35, but due to the deflection of beam 28, it is obvious that if it were not for cylindrical-plano lens 36, the focal point 41 would not fall within the prescribed horizontal focal area strip 45 of surface 40. However, lens 36 insures that nevertheless, no matter where light beam 28 falls on lens 35, it will always be focused within the narrow vertical confines of horizontal focal area 45.

Figure 10:
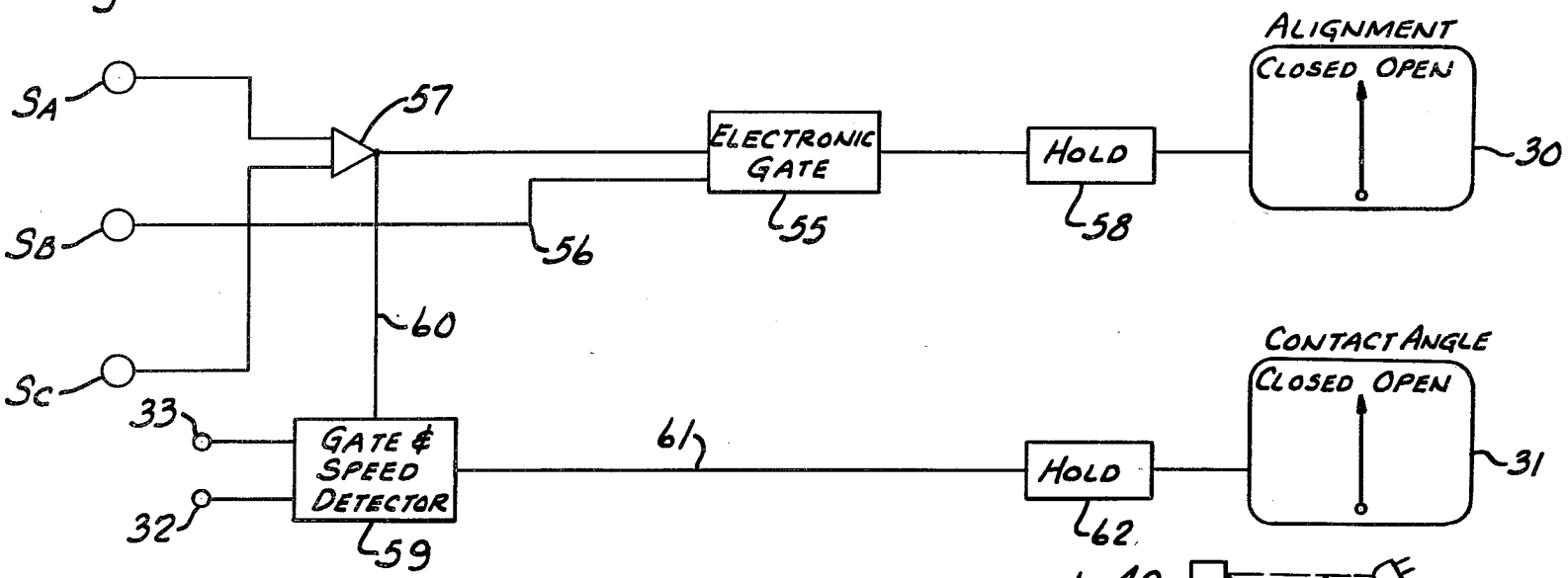
FIG. 10 is a schematic drawing of the operational electronic circuitry of the golf practice apparatus of FIG. 1.

Referring next to FIG. 10, this figure schematically illustrates the electronic circuitry for the sensing means and the indicating means. Light sensors SA, SB and SC are schematically illustrated along with velocity sensors 33 and 32. When the golfer first approaches the golf practice apparatus of the present invention and addresses the golf ball with the club head, preliminary to making an actual practice swing and for preliminary alignment, light will be reflected off of the club face and detected correspondingly by sensors SA, SB and SC, depending upon the angle of the club face. As previously explained, sensor SB is positioned such that its entire angle or field of view covers the entire sensor strip. Thus, as soon as sensor SB senses the presence of light, it activates electronic gate 55 via conductor 56. Electronic gate 55 is nothing more than basically a switch which is electronically closed when a signal is fed through conductor 56 from sensor SB. For example, in its simplest form, it might be nothing more than a solenoid-operated switch wherein energization of the sensor SB energizes the solenoid to close the switch, or gate 55 may be any conventional electronic gate.

Light is also sensed by sensors SA and SC, and their relative energization is compared by means of operational amplifier 57. If the light sensed by sensors SA and SC is equal in value (the face angle of the club head is square), then the output of op amp 57 will be zero. If the relative light sensed by sensors SA and SC is such that one is larger in value than the other, then the output of op amp 57 will be plus or minus accordingly, and also accordingly vary in value or magnitude.

Gate 55, having been closed by light sensed from sensor SB, the output of op amp 57 will pass through gate 55 and is stored in hold circuit 58 and at the same time utilized to energize alignment meter 30 to indicate whether the club face is open or closed in preliminary alignment of the club head when addressing the ball. As the golfer varies the alignment angle of the club face with the ball or point of impact, the needle of alignment meter 30 accordingly will vary to indicate when proper alignment is obtained and when the golfer retracts the golf club head away from the point of impact in preparation of an actual practice swing, hold circuit 58 will keep the needle of alignment meter 30 in the same position to continue to indicate the preliminary alignment of the club face which the golfer had for a period of time even though the club face is no longer addressing the golf ball. Hold circuit 58 may, for example, consist of nothing more than a field effect transistor coupled with a capacitor at the input to ground.

Then when the golfer advances the club head toward the point of impact or the golf ball for actual contact from the back swing position, the golf club head will pass over sensors 33 and 32 at a velocity above the aforementioned predetermined minimum value, and the combination gate and speed detector 59 will detect that the predetermined minimum velocity has been attained and thereby energize the gate or switch therein to connect conductur 60 with conductor 61. Thus, as the club head is passing through the point of impact, the output of op amp 57 will be fed to contact angle meter 31 via hold circuit 62, which is the same as hold circuit 59 in construction. Meter 31 will thus indicate the face angle of the club face at the time of impact, and will hold this value due to hold circuit 62 to give the golfer an opportunity to see what his face angle was at the time of actual impact after completion of the practice swing.

As previously explained, an actual golf ball may be mounted on the apparatus of the present invention at the impact point 13. In this manner, the golfer can actually see the reaction of the golf ball, when putting for example, in response to the alignment of his club face. Thus, with reference to FIG. 1, the golfer may set up a target 63, which may be a sunken cup, for example. However, to make certain that the cup 63 is squarely aligned with the golf practice apparatus 10 such that cup 63 is centrally aligned with center line 17, the sight illustrated in FIGS. 4*a* and 4*b* is utilized initially for alignment of apparatus 10 with target 63.

Sight 64 is nothing more than an optical cross-hair sight of tubular form. Sight 64 is in an L-shaped configuration and utilizes a conventional prism system to turn the corner at right angles to permit visual sighting down through the top 65 for alignment of the cross hairs 66 with a pole 67 temporarily extending up from the center of cup target 63. Sight 64 is rigidly secured and squared to its base 68, and base 68 is in turn provided with pre-positioned legs 69 which are spaced from each other and depend downwardly from base 68. Legs 69 are pre-aligned and pre-positioned to correspondingly seat down into holes 70 of the floor surface 12 of the golf practice apparatus 10 illustrated in FIG. 1, and holes 70 are further prealigned to align the cross hairs 66 to be on line with center line 17. Thus, by positioning legs 69 into holes 70, the golfer may align apparatus 10 with cup 63. After alignment has been accomplished, sight 64 is removed and the golfer is then ready to use the golf practice apparatus of the present invention in the manner previously described.

In describing the golf practice apparatus of the present invention with regard to the previous figures, it has been shown that the apparatus is insensitive to whether the face angle of the club is positioned or tilted back or forward at the time of ball impact, and that it only measures whether the face angle is open or closed at the time of impact. However, it may also be desirable to indicate whether the face angle is positioned forward or back at the time of ball impact, and this may also be accomplished with a second embodiment of the golf practice apparatus of the present invention. This feature is illustrated in FIGS. 11*a*, 11*b*, 12*a*, 12*b*, 13 and 14. In these figures, the same elements are designated with the same reference numerals.

Figures 11A, 11B, 12A, 12B, 13:
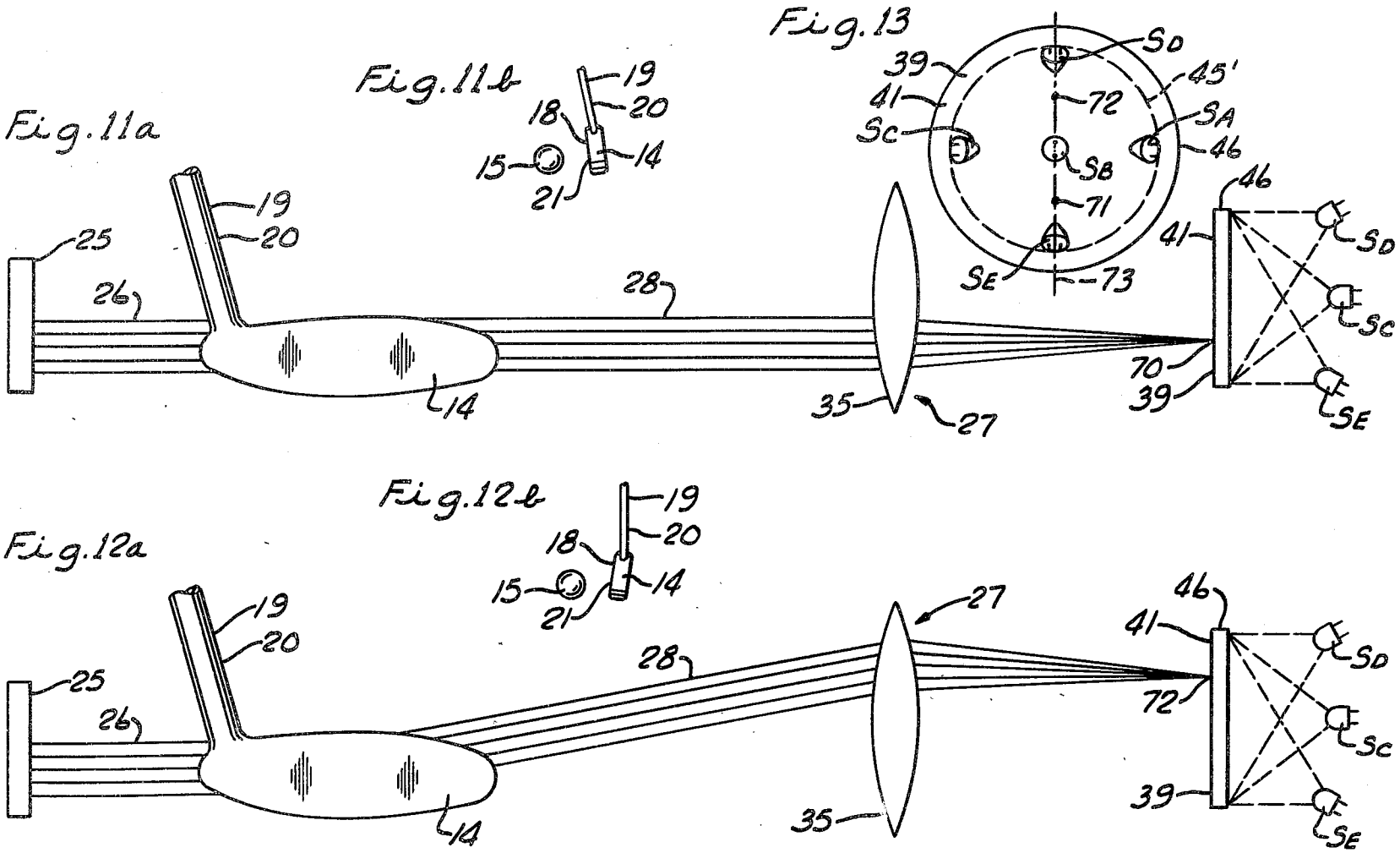

Referring to FIG. 11*a*, the club head 14 is improperly aligned as illustrated in 11*b*, wherein it is depicted that the vertical alignment of face 18 is forward instead of the correct position of vertical. Due to this alignment, as previously explained, light beam 27 will be deflected downwardly as indicated by reflected beam 28 off of reflective surface 21 of club head 14, and accordingly, beam 28 will engage the bottom surface of duo-convex lens 35. However, in this embodiment, the lens combination or lens means 27 does not include the cylindrical-plano lens utilized in the previously described embodiments. In addition, the focal area 45', as best seen in FIG. 13, of the light-diffusing surface 39 is now circular in configuration as opposed to being a narrow horizontal strip. The light-sensing strip further includes a vertical array of sensors in the form of additional sensors SD and SE, in addition to the horizontal array of sensors SA and SC and central sensor SB.

Thus, without the inclusion of the cylindrical-plano lens 36 of the previously described embodiment, the lens means is adapted to focus all light which is received as reflected from the club face to a predetermined focal area 45' on the light-sensing means such that the light is focused not only at horizontal positions but also at vertical positions thereon relative to the club face angle at the point of impact. Thus, not only is the face angle of the club being indicated on the light-diffusing surface 39 with regard to whether the face angle is open or closed, but in addition, vertical movement of the focal point 70 is being detected to indicate whether the face angle is forward or back.

FIG. 12*a* illustrates the situation when the club face angle is back as shown in FIG. 12*b*. In this instance, the focal point on light-diffusing surface 39 will fall at vertical position 72. In both the illustrations of FIGS. 11*a* and 12*a*, it is assumed that the face angle of the club is properly aligned in the horizontal plane, i.e., that the club face is neither open nor closed, but is only misaligned with regard to whether the face angle is forward or back. If the face angle is in addition open or closed, focal points 71 and 72 would lie somewhere within the focal area 45' other than on the vertical center line indicated at 73.

Figure 14:
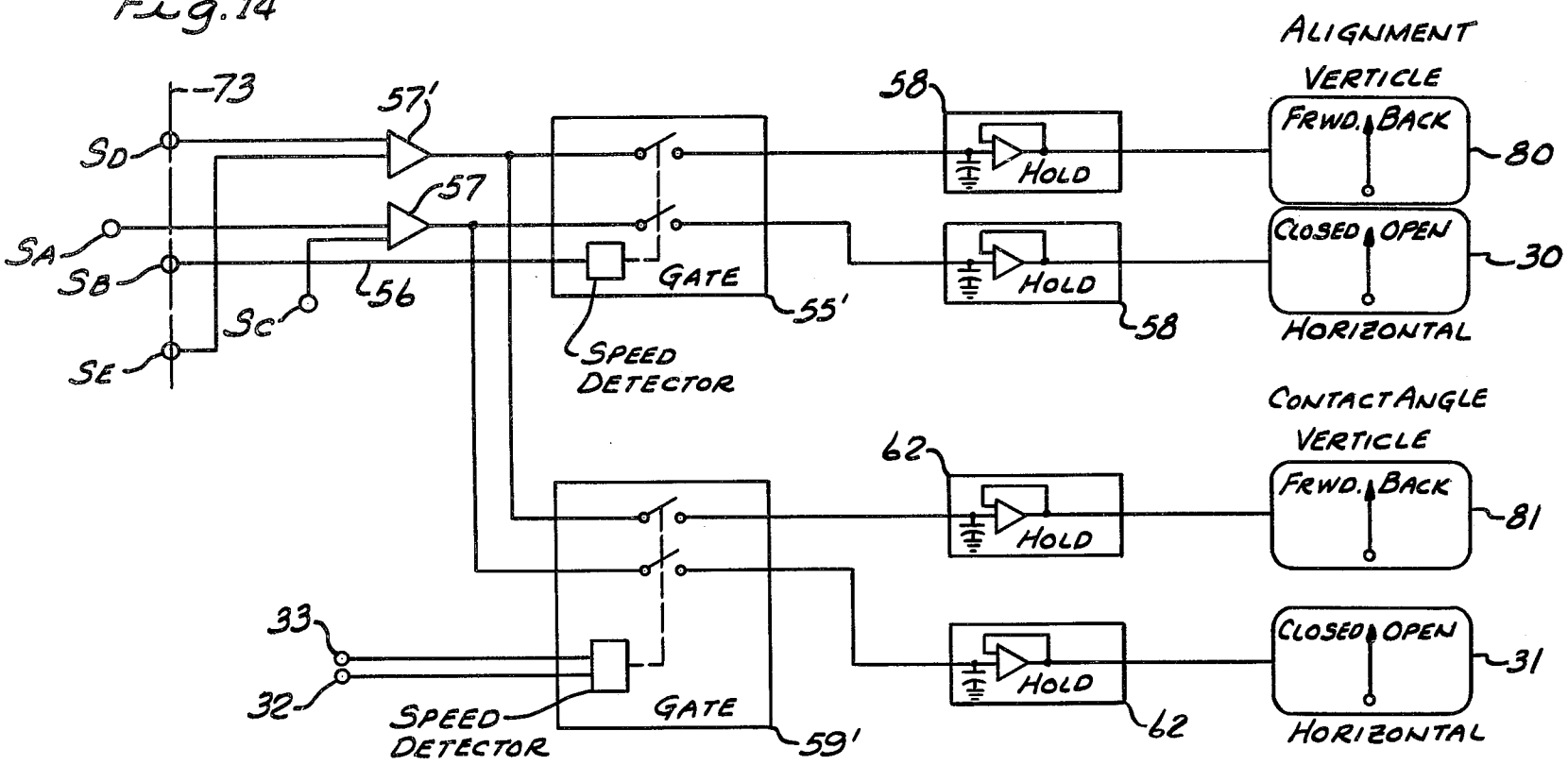

FIG. 14 schematically illustrates the inner workings of the embodiments illustrated in FIGS. 11*a* and 12*a*. This circuit operates in the identical manner as the circuit illustrated in FIG. 10, with the exception that all the circuitry is merely duplicated for the additional phototransistor sensors SD and SE. In the same manner, gate 55' is activated by central sensor SB, and an extra op amp 57' is provided to compare the signals from sensors SD and SE on vertical axis 73. Signals compared from these two sensors are fed to vertical alignment meter 80 to indicate whether the face angle of the club is forward or back, while signals from sensors SA and SC as compared are fed to meter 30 to indicate whether the face angle is open or closed in the manner previously described.

Also, as previously described, when the predetermined minimum forward velocity of the club head is attained while passing over speed detector sensors 33 and 32, the speed detector circuit within gate 59' will, upon detection of this minimum time interval between sensors 32 and 33 energize the gate to close the switches thereby connecting the output of op amps 57' and 57 to contact angle vertical meter 81 and horizontal meter 31 respectively and indicate whether the club face is forward or back and also indicate whether the club face is closed or open at the time of impact.

I claim:

1. A golf practice apparatus, comprising in combination, a base housing structure defining a normal point of impact of a golf club head during a practice swing, a golf club having a club handle with a head at the end thereof and a vertical light-reflective ball impact face on the head thereof, a source of light mounted on said base spaced from said point of impact and positioned to direct a concentrated beam of light in a generally horizontal path adjacent said point of impact for reflection off of said club face when approaching said point of impact during a practice swing, lens means on said base positioned to focus light from said source as reflected from said club face to light-sensing means, and indicating means coupled to said light-sensing means and responsive thereto to correspondingly indicate the golf club face angle at said point of impact.

2. The golf practice apparatus of claim 1, wherein said lens means is adapted to focus all light which it receives as reflected from said club face to a narrow predetermined horizontal focal area strip on said light-sensing means such that light is focused at horizontal positions thereon relative to the club face angle at the point of impact.

3. The golf practice apparatus of claim 2, wherein said predetermined focal area strip on said light-sensing means is a light-diffusing surface positioned to receive focused light from said lens means.

4. The golf practice apparatus of claim 3, wherein said light-sensing means includes a plurality of light sensors positioned in a horizontal array to sense light from said respective horizontal positions of said light-diffusing surface for relative energization of said sensors.

5. The golf practice apparatus of claim 4, wherein said light-diffusing surface is a translucent plate, and said sensors are positioned therebehind.

6. The golf practice apparatus of claim 5, wherein said translucent plate is ground glass.

7. The golf practice apparatus of claim 2, wherein said lens means includes a lens having a cylindrical surface on one side facing away from said strip and with the axis thereof horizontally aligned with said strip and the other side of said lens being a substantially flat vertical surface facing and in parallel alignment with said strip area.

8. The golf practice apparatus of claim 1, including club head speed detection means in said base to detect a predetermined minimum velocity of said club head upon approaching said point of impact, and thereupon activate said indicating means to indicate club face angle only when said minimum velocity is attained.

9. The golf practice apparatus of claim 8, including second indicating means coupled to said light-sensing means and responsive thereto to correspondingly indicate the golf club face angle on approach to said point of impact during approach swings of said club head at velocities less than said predetermined minimum.

10. The golf practice apparatus of claim 1, said base structure further defining a normal path of swing for a golf club head on correct approach to asaid point of impact, and sight means attachable to said base at a predetermined aligned position to permit sight alignment of said normal path with a golf ball target spaced from said base.

11. The golf practice apparatus of claim 1, wherein said lens means is adapted to focus all light which it receives as reflected from said club face to a predetermined focal area on said light-sensing means such that light is focused at horizontal and vertical positions thereon relative to the club face angle at the point of impact.

12. The golf practice apparatus of claim 11, wherein said predetermined focal area on said light-sensing means is a light-diffusing surface positioned to receive focused light from said lens means.

13. The golf practice apparatus of claim 12, wherein said light-sensing means includes a plurality of light sensors positioned in a horizontal array and a plurality of light sensors positioned in a vertical array to sense light from said respective horizontal and vertical positions of said light-diffusing surface for relative energization of said sensors.

14. The golf practice apparatus of claim 13, wherein said light-diffusing surface is a translucent plate and said sensors are positioned therebehind.

15. The golf practice apparatus of claim 14, wherein said translucent plate is ground glass.

16. A golf practice apparatus, comprising in combination a base having structure defining a normal point of impact of a golf club head during a practice swing, a golf club having a club handle and head and a vertical ball impact face on the head thereof, a light-reflective surface affixed on said club at a predetermined position such that light reflected therefrom will be indicative of the angle of said club face when approaching said point of impact, a source of intense light mounted on said base spaced from said point of impact and positioned to direct a concentrated beam of light in a path adjacent such point of impact for reflection off of said light-reflective surface when said face is approaching said point of impact during a practice swing, lens means on said base positioned to focus light from said source as reflected from said light-reflective surface to a predetermined focal area on a light-diffusing surface such that light is focused at positions thereon relative to the club face angle at the point of impact, a plurality of light sensors positioned in an array to sense light from said respective positions on said light-diffusing surface for relative energization of said sensors, and indicating means coupled to said sensors and responsive to their respective relative energization to indicate the golf club face angle at said point of impact.

17. The golf practice apparatus of claim 16, wherein said light-diffusing surface is a translucent plate and said sensors are positioned therebehind.

* * * * *